US010960405B2

(12) United States Patent
Beard et al.

(10) Patent No.: US 10,960,405 B2
(45) Date of Patent: Mar. 30, 2021

(54) MAGNETIC FILTER

(71) Applicant: Air BP Limited, Middlesex (GB)

(72) Inventors: Darren Beard, Middlesex (GB); Arthur James Mitchell, Singapore (SG)

(73) Assignee: AIR BP LIMITED, Middlesex (GB)

( * ) Notice: Subject to any disclaimer, the term of this patent is extended or adjusted under 35 U.S.C. 154(b) by 0 days.

(21) Appl. No.: 16/087,626

(22) PCT Filed: Mar. 24, 2017

(86) PCT No.: PCT/EP2017/057103

§ 371 (c)(1),
(2) Date: Sep. 21, 2018

(87) PCT Pub. No.: WO2017/162864

PCT Pub. Date: Sep. 28, 2017

(65) Prior Publication Data

US 2019/0099762 A1 Apr. 4, 2019

(30) Foreign Application Priority Data

Mar. 24, 2016 (GB) ..... 1605181

(51) Int. Cl.
*B03C 1/28* (2006.01)
*B03C 1/033* (2006.01)

(52) U.S. Cl.
CPC ..... *B03C 1/284* (2013.01); *B03C 1/0332* (2013.01); *B03C 1/286* (2013.01); *B03C 2201/18* (2013.01); *B03C 2201/28* (2013.01)

(58) Field of Classification Search
CPC ..... B03C 1/284; B03C 1/0332; B03C 1/286; B03C 2201/28; B03C 2201/18;
(Continued)

(56) References Cited

U.S. PATENT DOCUMENTS 2,680,519 A * 6/1954 Rundquist ..... B01D 35/06 210/223
2,789,655 A * 4/1957 Preston ..... B03C 1/0332 96/1

(Continued)

FOREIGN PATENT DOCUMENTS

CN 2620092 6/2004
CN 201940115 8/2011

(Continued)

*Primary Examiner* — Nam X Nguyen
*Assistant Examiner* — Ekandra S. Miller-Cruz
(74) *Attorney, Agent, or Firm* — McDonnell Boehnen Hulbert & Berghoff LLP

(57) ABSTRACT

A magnetic filter carriage (16) for use in filtering contaminants from fluid in a high pressure fluid flow comprises a frame (18, 20, 22) arranged to support a plurality of magnet filter rods (42), such that the rods (42) are each supported at both ends thereof in a fixed orientation, for example parallel to one another. The frame (18, 20, 22) is adapted to be inserted within a pressure vessel (4) across the direction of fluid flow between a fluid inlet (7) and a fluid outlet (9) of the pressure vessel (4), and may be arranged such that more than about 90% of the flow across the vessel (4) passes through the frame (18, 20, 22). The rods (42) are mounted in a plurality of cassettes (36) which are easily removable for cleaning or replacement.

19 Claims, 5 Drawing Sheets

(58) Field of Classification Search
CPC ..... B03C 1/0335; B03C 1/00; B03C 1/032; B03C 1/034; B03C 1/08; B03C 1/14; B03C 1/22; B03C 2201/22; B03C 1/02; B03C 1/031; B01D 21/00; B01D 21/0009; B01D 46/0034; B01D 2201/4069; B01D 35/06
USPC ..... 210/695, 167.03, 167.29, 222, 223; 209/38, 39, 40, 509, 562, 609, 220, 209/223.1, 226, 230, 232, 368, 478, 47, 8
See application file for complete search history.

(56) References Cited

U.S. PATENT DOCUMENTS 3,139,403 A * 6/1964 Cramer ..... B03C 1/28 210/222
4,201,140 A * 5/1980 Robinson ..... C10G 32/02 110/218
4,750,998 A * 6/1988 Nakamur ..... C02F 1/48 210/223
4,946,589 A * 8/1990 Hayes ..... B01D 35/06 209/223.1
5,043,063 A * 8/1991 Latimer ..... B03C 1/284 210/222
5,188,239 A 2/1993 Stowe
5,819,949 A 10/1998 Schaaf et al.
6,077,333 A * 6/2000 Wolfs ..... B03C 1/288 96/1
6,743,365 B1 * 6/2004 Marlowe ..... B03C 1/0335 210/695
8,900,449 B2 * 12/2014 Lin ..... B03C 1/286 210/223
2002/0139740 A1 * 10/2002 Asterlin ..... B03C 1/284 210/222
2003/0173264 A1 9/2003 Yang
2003/0183580 A1 * 10/2003 Schaaf ..... B03C 1/286 210/695
2009/0272702 A1 * 11/2009 Yen ..... B01D 29/23 210/806
2010/0065504 A1 * 3/2010 Yen ..... B01D 29/23 210/695
2010/0176045 A1 * 7/2010 Oshana ..... C02F 1/481 210/223
2012/0165551 A1 6/2012 Yen et al.
2012/0175293 A1 * 7/2012 Kuo ..... B01D 35/0273 210/236
2013/0240455 A1 9/2013 Lin et al.
2014/0343335 A1 * 11/2014 Pellette ..... B01D 49/00 585/254
2019/0093685 A1 3/2019 Beard et al.

FOREIGN PATENT DOCUMENTS

CN 203030389 7/2013
CN 203916872 11/2014
CN 203916872 U * 11/2014 ..... B03C 1/02
DE 33 07 319 9/1984
JP 3 120813 U 4/2006
WO WO-2016159779 A1 * 10/2016 ..... B03C 1/0332
WO WO 2017/12866 9/2017

* cited by examiner

MAGNETIC FILTER

CROSS REFERENCE TO RELATED APPLICATION

This application is a National Phase application of, and claims the benefit of, International (PCT) Application No. PCT/EP2017/057103, filed Mar. 24, 2017, which claims priority to GB Patent Application No. 1605181.5, filed Mar. 24, 2016, each of which is hereby incorporated by reference in its entirety.

This invention relates to magnetic filters or strainers, in particular for use in fuel pipelines, for example for removal of magnetic, ferromagnetic or paramagnetic particles from petroleum products, such as liquid fuels, for example aviation kerosene.

Fuel such as aviation fuel being delivered to a fuel delivery facility, for example at an airport, may contain contaminants, for example rust particles, from the pipeline or from transport storage such as the hold of a ship. Therefore it is required to filter such fuel before it is dispensed for use.

BACKGROUND

Fuel filters are well known in the art and usually take the form of in line filtering materials, such as a paper, mesh, fibrous or woven filter cartridges. The fuel is passed through the filter material such that any contaminant particles are collected on the upstream surface of the material. A problem with these filters is that they have to be removed and either cleaned or replaced periodically in order to remove the contaminants which gradually block the filter material. Furthermore the pressure differential across the filter builds up as the filter becomes dirty, requiring more energy to pump the fuel through the filter. The magnitude of the pressure differential is an indication of the state of the filter, and therefore can be used to ascertain when the filter should be removed and replaced. This system of filtering is costly in terms of replacement costs and energy costs.

Magnetic filters are known, for example for use in domestic heating systems. A magnet rod is inserted in a thin walled tubular housing extending into the pressure vessel. The magnets attract debris in the fluid, in particular magnetic iron and steel particles such as rust, which collects around the tube. The system will need cleaning when sufficient debris has built up to form a barrier between the magnets and the fluid, which reduces the efficiency of rust collection due to the radial distance of the new material being collected from the magnetic core. This can be determined by visual inspection. However such a filter is not suitable for high pressure environments such as fuel pipelines, since it would be necessary for the tube to withstand a very high pressure differential between the fuel in the vessel and atmosphere. Furthermore it is difficult to determine when the filter is clogged since visual inspection would require the system to be drained.

Magnetic filters have been proposed fore use in pipelines comprising a pipe section of increased diameter, with a large aperture formed in the pipe wall for receiving a magnet filter unit. The unit comprises a plurality of filter rods extending parallel to each other and connected at one end to an end plate for fitting into and securing around the aperture. A disadvantage of this arrangement is that 'dead' zones exist around the rods, commonly amounting to around 30% of the cross-sectional area of the pipe. Also, such a system is not practical for use in large or high pressure pipelines, or those carrying hazardous fluids, since the unit would be extremely heavy and cumbersome to manipulate due to the need to remove a large pressure containing flange with multiple magnetic rods, and the requirements for sealing around the end plate would be extremely difficult to achieve. It has therefore been difficult to use magnetic filters for fuel pipelines. The present invention aims to alleviate some or all of these problems.

SUMMARY

According to the present invention, there is provided a magnetic filter carriage for use in removing magnetically susceptible contaminants from fluid in a fluid flow, the carriage comprising a frame arranged to support a plurality of elongate magnetic rods, such that the rods are each supported at both ends thereof in a fixed orientation, the frame being adapted to be mounted within a pressure vessel across the direction of fluid flow between a fluid inlet and a fluid outlet of the pressure vessel.

As used herein, "magnetically susceptible contaminants" shall mean contaminants that are attracted to the source of a magnetic field applied to the fluid within which the contaminant is contained, such as the magnetic rods in the case of the present invention.

The magnetic rods of the present invention are or comprise a strong permanent magnet or magnets, preferably a rare earth magnet, and are constructed such that the magnetic rod is resilient to the fluid within which it is to be used. One particularly suitable type of magnetic rod comprises elongate tubes containing a plurality of magnets within the tube, wherein the magnets are arranged end-to-end within the tube, preferably the magnets contained within this form of magnetic rod are rare earth magnets. Suitable magnetic rods which may be used in the present invention would be known to a person skilled in the art.

Since the magnetic filter carriage can be provided directly in a sealed pressure vessel, there is no requirement for it and the components of it to be manufactured such that they are able to withstand a high pressure differential, so the magnetic rods and the means by which they are mounted may be constructed in a way that does not provide high levels of resistance to pressure differentials and may thus be lighter and cheaper. Furthermore, the magnetic filter carriage is a standalone unit which is separate to and can be completely inserted and supported within a pressure vessel, which simplifies the construction of the pressure vessel and reduces the risk of leakage.

The magnetic filter carriage may have a cross-sectional area which receives at least about 90%, or at least about 95%, of the fluid flow through the pressure vessel, such that efficiency of the removal of the magnetically susceptible contaminants is increased.

Whilst it is not essential to the magnetic filter carriage of the present invention, in order to assist in the handling of, loading in to, or removing of the magnetic filter carriage in a pressure vessel, it may be preferable that the frame of the magnetic filter carriage is adapted to be slidable within the vessel. Thus, in one embodiment of the present invention, the magnetic filter carriage may comprise guide members for cooperating with corresponding guide members located within the pressure vessel; alternatively, other slidable arrangements such as rollers or wheels may also be used. Thus, through use of such means, the magnetic filter carriage may easily be lifted or lowered out of or in to the pressure vessel, or be slidable in to or out of the pressure vessel through an arrangement in another orientation such as horizontally.

The frame of the magnetic filter carriage is configured to support a plurality of elongate magnetic rods. In some embodiments of the present invention, the frame of the magnetic filter carriage is arranged to support the magnetic rods such that they extend substantially parallel to each other.

In one embodiment of the present invention, the magnetic rods may be conveniently mounted in two or more cassettes, each cassette comprising a plurality of magnetic rods, such as from two to ten magnetic rods, for example two, three or four magnetic rods, wherein each of the magnetic rods in the cassette is mounted to one or more blocks or plates, preferably being mounted to the blocks or plates at or adjacent the ends of the magnetic rods. Whilst not essential to the present invention, the magnetic rods may be conveniently mounted in a parallel or approximately parallel within each cassette. The cassettes may then be removably mounted to the frame to form the magnetic filter carriage. Thus, through us of such an arrangement, the handling of the magnetic filter carriage may be made easier since the removal of one or more of the cassettes will reduce the overall weight of the magnetic filter carriage. Furthermore, since each cassette will comprise a reduced number of magnetic rods compared to the magnetic filter carriage, each cassette will be lighter and easier to handle compared to the magnetic filter carriage, and may easily be detached from the magnetic filter carriage to facilitate easier or more convenient cleaning and/or replacement of the magnetic rods.

According to another aspect of the present invention there is provided a magnetic filter system comprising a pressure vessel and a magnetic filter carriage as defined above. The pressure vessel preferably comprises substantially parallel opposed side walls on which guide members, such as tracks or rails, are mounted, the guide members being configured to cooperate with guide members, such as tracks or rails, present on the magnetic filter carriage. Alternatively, the pressure vessel may be provided with internal fitments for mounting the tracks or rails, or may be tapered, for example in a 'V' shape, to cooperate with the magnetic filter carriage which may have a corresponding shape. In some cases, the magnetic filter carriage may be formed in an irregular shape for fitting into a correspondingly shaped housing in the pressure vessel.

The pressure vessel also preferably comprises an openable lid or hatch, preferably said lid or hatch is of sufficient dimension so as to allow insertion and removal of the magnetic filter carriage in to and out of the pressure vessel. The pressure vessel is not limited in shape, however, conveniently the pressure vessel may be substantially cylindrical in shape. When the pressure vessel comprises a hatch or lid, the location of the hatch or lid is not limited and may be position such that it allows convenient access to the magnetic filter carriage in the location where the pressure vessel is located, for example the hatch or lid may be at the top should it be desirable to access the magnetic filter carriage from above, for example to enable insertion and removal of the magnetic filter carriage by a lifting and lowering means; or it may be located at the side of the pressure vessel should it be desirable to access the magnetic filter carriage from the side, for example to enable horizontal insertion and removal of the magnetic filter carriage. If the pressure vessel is substantially cylindrical in shape and is configure such that the longitudinal dimension of the pressure vessel is perpendicular or at a tangent to one or more of the inlet and outlet pipes to the pressure vessel, any hatch or lid that may be present in the pressure vessel may conveniently be located at the end of the cylindrical section of the pressure vessel.

The magnetic filter carriage and system of the present invention may be used in pipelines used for transporting any fluid or other substance with fluid-like behaviour; preferably, the magnetic filter carriage and system of the present invention may be used in pipelines used for transporting liquid. In one particular embodiment of the present invention, the magnetic filter carriage and system of the present invention is used in pipelines used for transporting petroleum products, more particularly the magnetic filter carriage and system of the present invention may be used in pipelines used for transporting liquid fuels, such as aviation kerosene or aviation gasoline.

The magnetic filter carriage and system of the present invention may conveniently be suitable for use under the following operating conditions: operating pressures in the range of from 2 to 100 bar, such as pressure in the ranges of from 3 to 100 bar, 5 to 80 bar, 5 to 70 bar, 5 to 50 bar, 10 to 40 bar, or pressures in the ranges from 2 to 10 bar, 5 to 10 bar or 30 to 100 bar incoming liquid flow rate in the range of from 20 to 2000 $m^3$ per hour, such as incoming liquid flow rates of from 20 to 1000 $m^3$ per hour, 100 to 800 $m^3$ per hour, 100 to 500 $m^3$ per hour, or 100 to 400 $m^3$ per hour, or alternatively flow rates in the range of from 500 to 2000 $m^3$ per hour or 750 to 1500 $m^3$ per hour.

Thus, the pressure vessel is preferably a pressure vessel configured to contain fluid at a pressures in the range of from 2 to 100 bar, such as pressure in the ranges of from 3 to 100 bar, 5 to 80 bar, 5 to 70 bar, 5 to 50 bar, 10 to 40 bar, or pressures in the ranges from 2 to 10 bar, 5 to 10 bar or 30 to 100 bar.

The pressure vessel is preferably a pressure vessel configured to contain fluid under pressure at temperatures in the range of from −30 to +60° C., or −10 to +50° C., or −5 to +40° C., or 0 to +30° C.

The magnetic filter carriage is configured to remove magnetically susceptible contaminants from a fluid flowing at a rate of from 20 to 2000 $m^3$ per hour, such as fluid flow rates of from 20 to 1000 $m^3$ per hour, 100 to 800 $m^3$ per hour, 100 to 500 $m^3$ per hour, or 100 to 400 $m^3$ per hour, or alternatively flow rates in the range of from 500 to 2000 $m^3$ per hour or 750 to 1500 $m^3$ per hour The temperature range under which the magnetic filter carriage and system of the present invention may be used will be known to the skilled person based on the materials used and the fluid to which the magnetic filter carriage is to be used with. Typically, when the magnetic filter carriage and system of the present invention are used in pipelines for transporting petroleum products, the petroleum products may typically be exposed to the magnetic filter carriage at temperatures in the range of from −30 to +60° C., or −10 to +50° C., or −5 to +40° C., or 0 to +30° C.

The incoming pipeline to the pressure vessel at least 20 meters up-stream of the vessel may typically have an internal diameter greater than 6" (152.4 mm), or greater than 8" (203.2 mm), or greater than 12" (304.8 mm), or greater than 18" (457.2 mm), or even greater than 24" (609.6 min).

BRIEF DESCRIPTION OF THE DRAWINGS

In order that the present invention may be more readily understood, reference will now be made by way of example to the accompanying drawings, in which.

DETAILED DESCRIPTION

Figure 1:
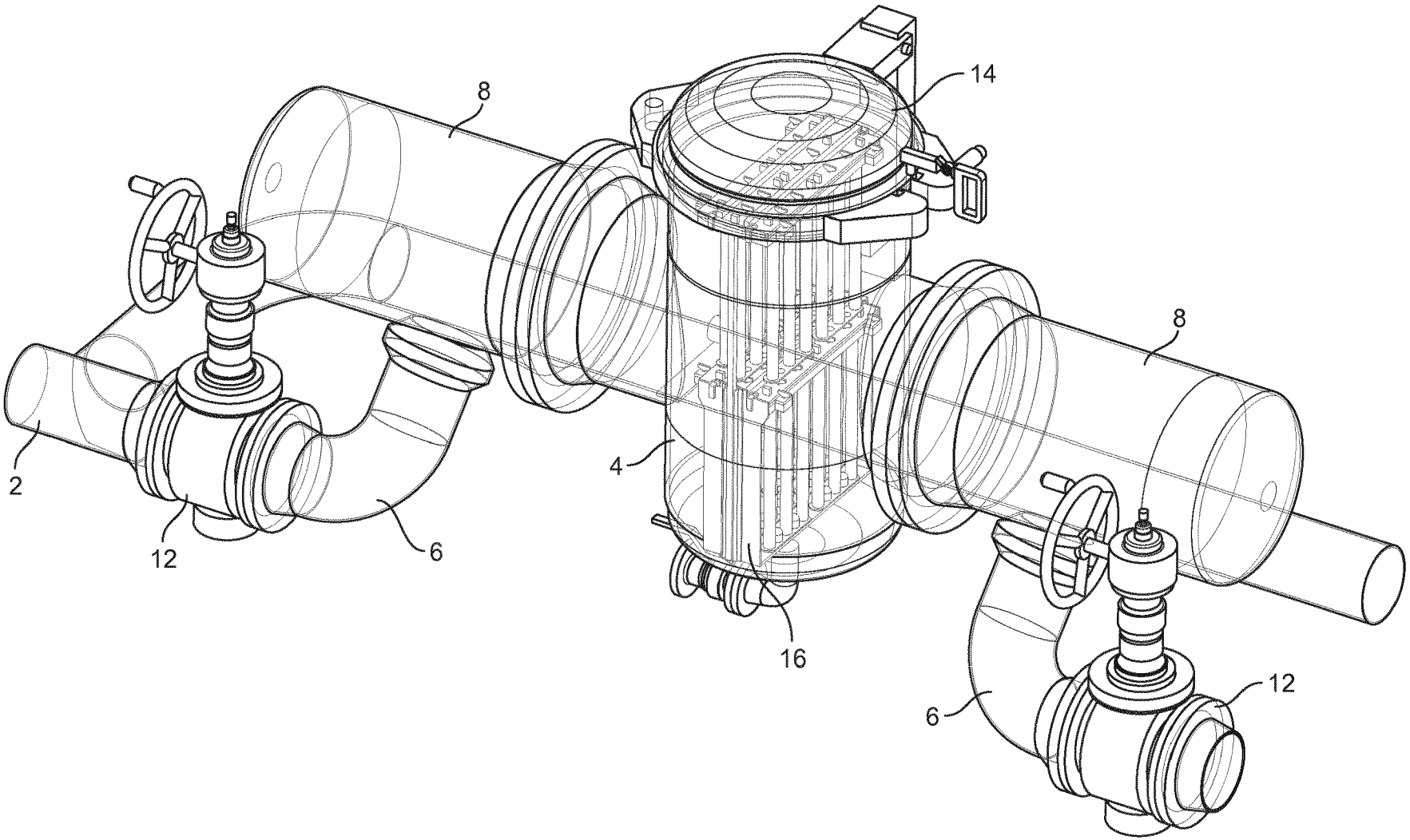
FIG. 1 is a perspective view of a filter arrangement comprising a pressure vessel including a magnetic filter carriage.
Figure 2:
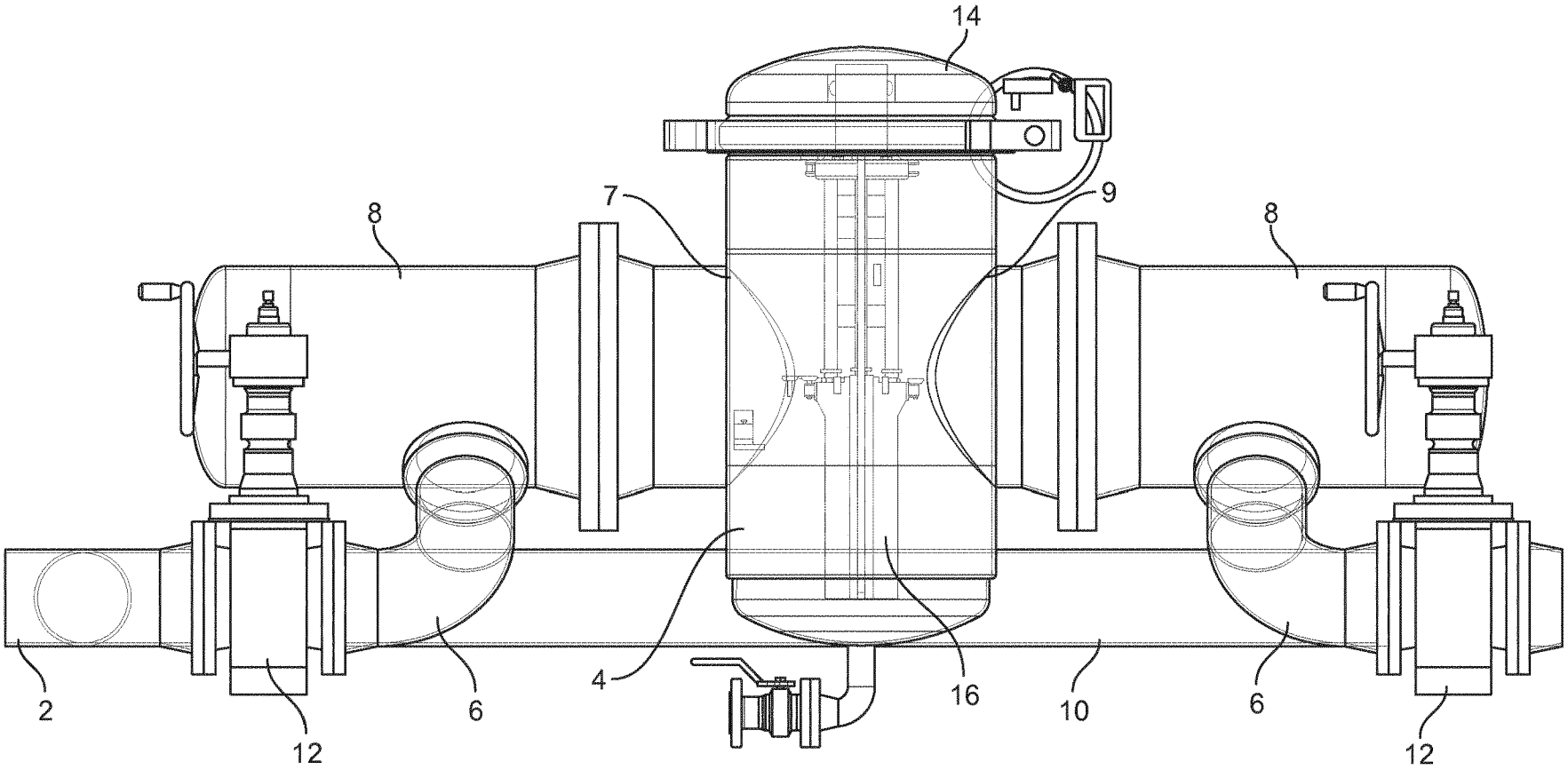
FIG. 2 is a side view of the filter arrangement of FIG. 1.

Referring now to FIGS. 1 and 2, a high pressure pipe line 2 is shown for carrying fluid such as a petroleum product, for example an aviation fuel. A filtration path including a pressure vessel 4 is provided in the pipe line by means of a pair of elbow sections 6, and a pair of large diameter pipe sections 8 on either side of the vessel 4. A bypass flow path is also provided in the form of a bypass pipeline 10 for bypassing the pressure vessel 4, with valves 12 for selecting the required path.

Typical dimensions of the pipe might be about greater than or equal to about 6 inches, 8 inches, or 12, 18 or 24 inches with the large diameter pipe being about 0.5 to 1.5 or 1 to 2, 1.5 to 3 metres in diameter, and the vessel approximately 1, 1.5 or 2.0 metres tall, and 0.5 to 2, or 0.5 to 1.5 or 0.5 to 1 metres wide. However, other dimensions and multiple inlets or outlets are also possible.

The elbow sections 6 are each connected through a wall of one of the large diameter pipe sections 8, which extend substantially parallel to the pipe line. The vessel 4 is substantially cylindrical, extending substantially perpendicular to the large diameter pipe sections 8, and the large diameter sections 8 are connected through the walls of the vessel in opposed relation to provide an inlet 7 and outlet 9 respectively for the fluid flow across the vessel 4. Typical dimensions of the pipe might be about 8 inches, with the large diameter pipe being about 0.5 metre in diameter, and the tank approximately 1.1 metres tall, and 580 mm wide. However, other dimensions and multiple inlets or outlets are also possible.

The vessel includes an access hatch 14 at the top, which may be hingedly opened. The vessel 4 supports a magnetic filter carriage 16 extending across the diameter of the vessel perpendicular to the flow direction between the inlet and the outlet. The carriage carries a plurality of magnetic filter rods, as will be described below, for filtering particles from the flow.

Figure 3:
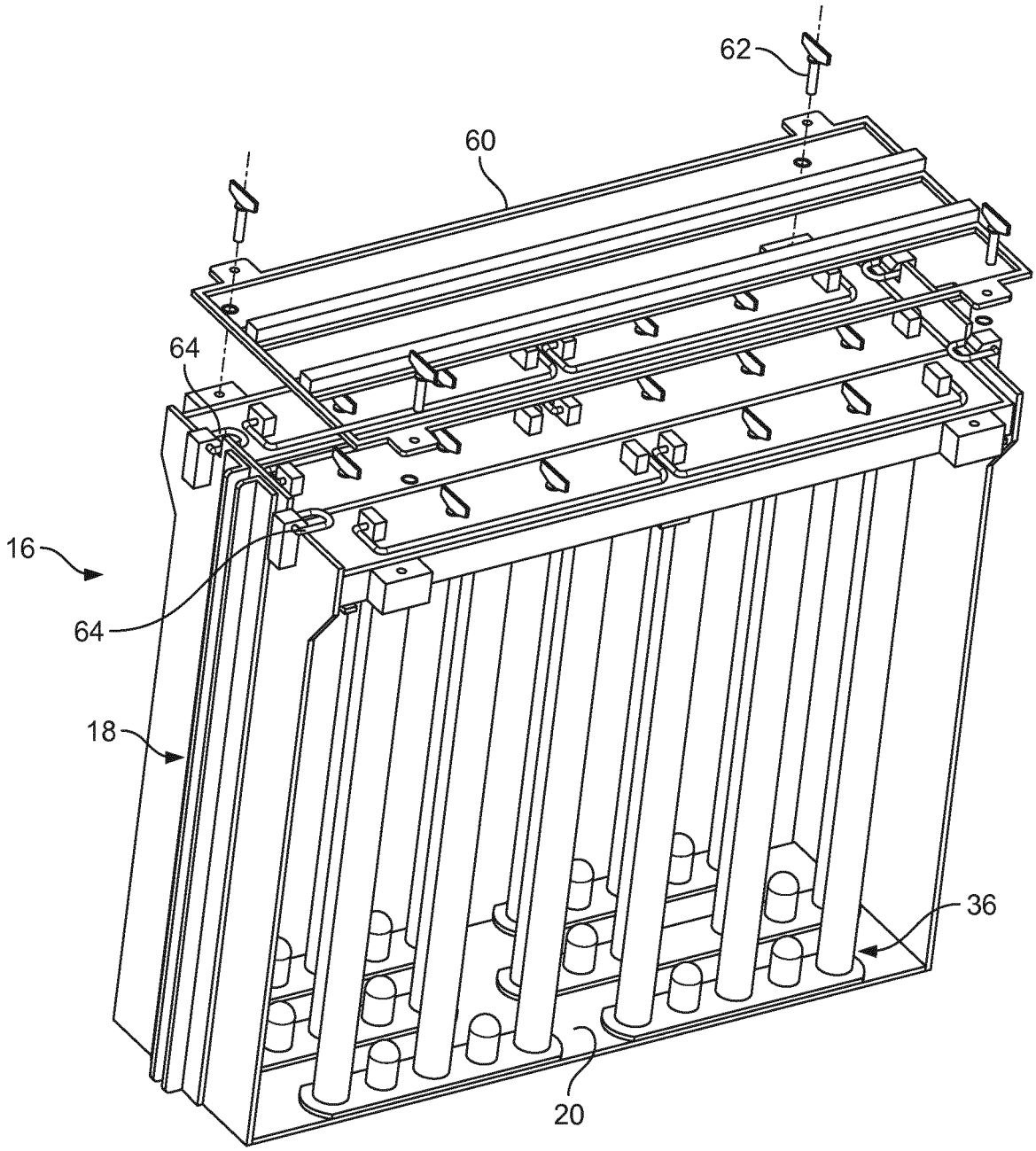
FIG. 3 is a perspective view of a filter carriage including filter rods.
Figure 4:
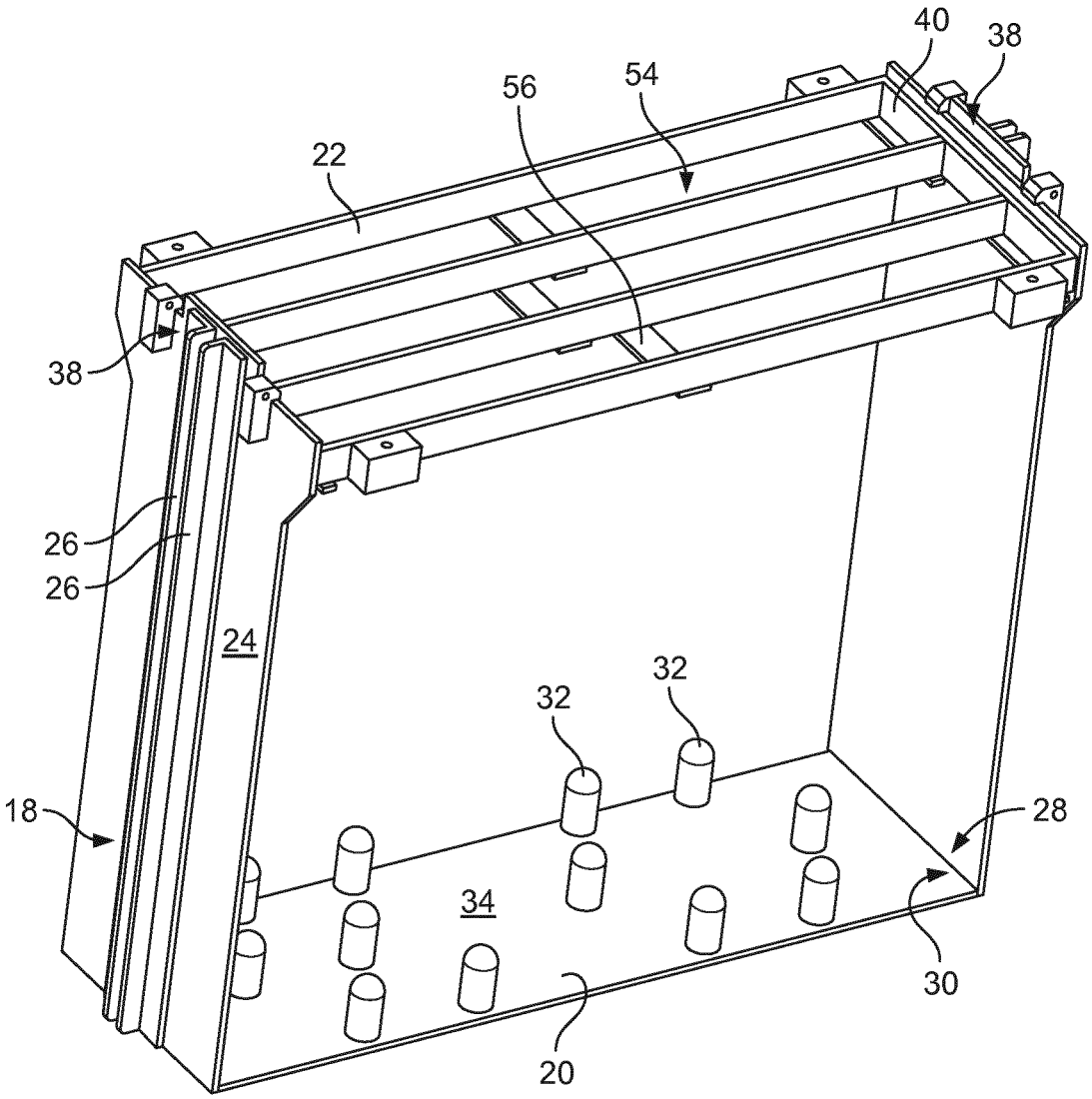
FIG. 4 is a perspective view of the carriage frame of FIG. 3.

Referring now to FIGS. 3 and 4, the carriage 16 comprises a frame including a pair of side plates 18, a lower guide plate 20 extending between the lower edges of the side plates 18, and a block cage 22 extending between the upper edges of the side plates 18.

The side plates 18 are rectangular, and are each provided on an outer face 24 thereof with a pair of parallel elongate flanges 26 extending along the length thereof and serving as guide rails for cooperating with corresponding tracks (not shown) on the side walls of the pressure vessel 4. The side plates 18 are preferably welded along their short sides 28 to opposing short sides 30 of the guide plate 20, which is rectangular and has a corresponding width. The side plates may alternatively be removable to allow alternative configurations to be used for accommodating different carriage designs.

The guide plate 20 has locating pegs 32 extending from an inner face 34 thereof for locating a plurality of magnet rod cassettes 36. The block cage is also rectangular, and is preferably welded along opposite short sides 40 to the upper short sides 38 of the side plates.

Figure 5:
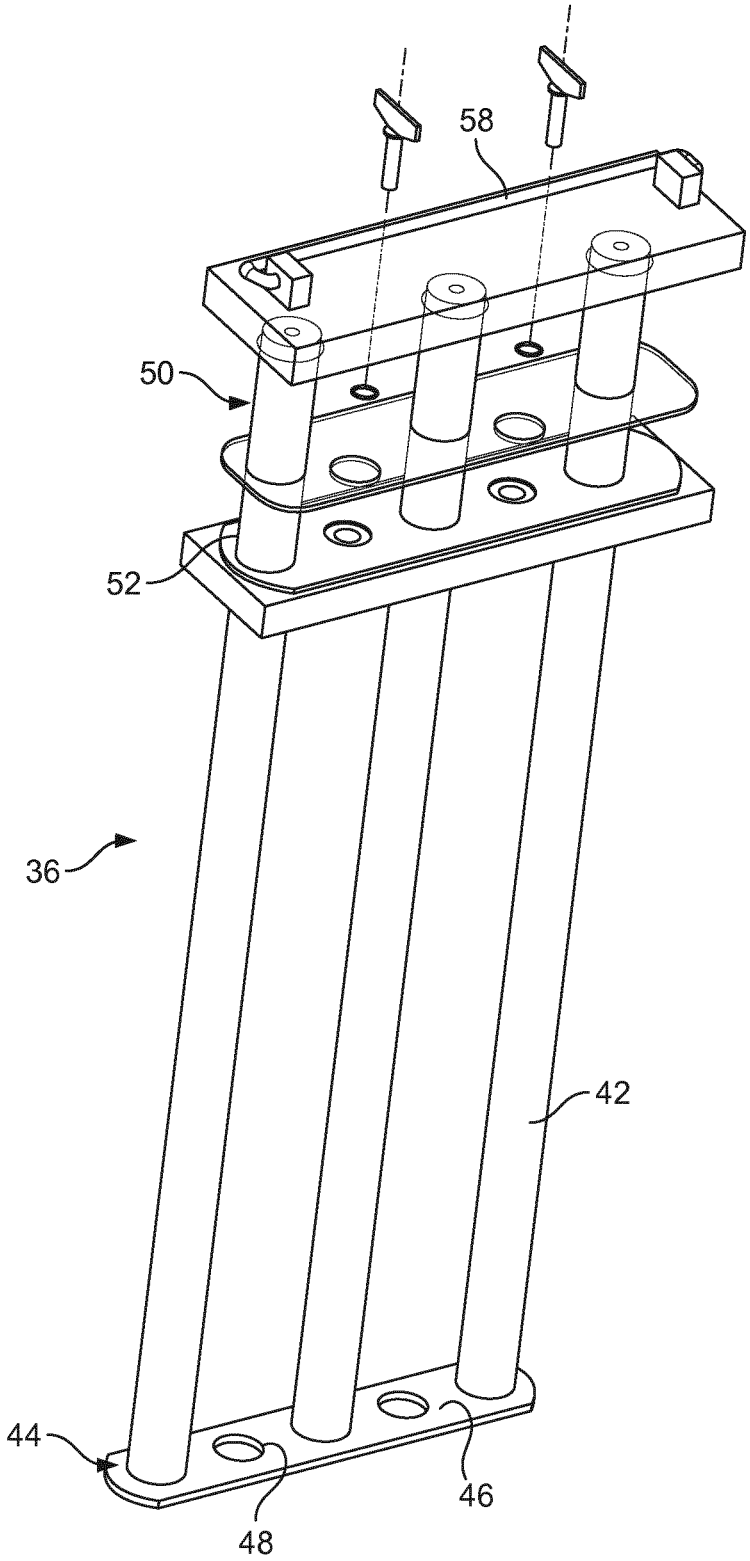
FIG. 5 is a perspective view of a rod cassette of FIG. 3.

Referring also to FIG. 5, each magnet rod cassette 36 is sized so as to be convenient for manual handling, for example comprising three or four long rods 42. The rods 42 each comprise a tube containing a plurality of magnets, as is well known in the art. The rods are each attached at their lower ends 44 to an elongate retaining plate 46 such that the ends 44 are aligned along the length of the plate. The retaining plate 46 also comprises locating apertures 48 between the rods sized to fit over the locating pegs 32 in the guide plate 20 of the carriage frame so as to hold the cassette firmly in place and reduce any flow induced vibration.

At the top end 50, the rods pass through corresponding elongate retaining blocks 52 such that they extend substantially parallel and in fixed relation to each other. Each retaining block 52 has a width corresponding to lengthwise gaps 54 in the block cage 22 so as to fit closely therein when the cassette 36 is fitted in the frame 16 as can be seen from FIGS. 3 and 4. The block cage 22 additionally has retaining bars 56 which are spaced apart to correspond with the length of each block 52.

The blocks 52 are each provided with a handle 58 for lifting the cassettes out of the frame. A retaining frame 60 may be secured to the block cage 22, for example using quick release fasteners 62 to retain the cartridges in the frame. The side plates 18 are each provided with a pair of steel shackles 64 which can be used to lift and lower the carriage 16.

The frame and cassettes are arranged to provide offset rows of rods. Thus in this example there are three rows of two cassettes. The outer rows comprise two cassettes containing three rods each, and the inner row comprises two cassettes, one containing four rods and the other containing three rods.

In use, the hatch 14 of the vessel 4 is opened, the carriage 16 is lowered into the vessel 4, and the hatch is closed. With the valves 12 directing the flowthrough the filter path, the flow enters an elbow section 6, and is directed into a larger diameter pipe section 8. Consequently, the speed of the flow is reduced. The fluid then enters the vessel 4 through the inlet 7, with the speed once again reduced due to the larger cross-sectional area presented by the vessel, and passes through the filter carriage and between the magnet rods. Particles such as magnetised steel and rust particles are attracted by the magnetic fields and adhere to the rods. The filtered fluid exits the vessel 4 through the outlet 9 into the other large pipe section 8 and back to the pipeline via the elbow section.

As material builds up on the rods, the ability of the magnetic field to capture further particles decreases until the level of filtration achieved falls below useful levels. The rods therefore need to be cleaned or replaced periodically. With this arrangement, each cassette can be separately removed for cleaning or replacement. Thus any damaged or worn cassette can be replaced allowing continued operation.

Additionally each rod may easily be removed, from the cassette. The rods may be cleaned using a wash solution which is miscible or compatible with the fluid within the pipe, or with non-compatible liquids (such as water when the fluid is a fuel).

The invention claimed is:

1. A magnetic filter carriage for use in removing magnetically susceptible contaminants from fluid in a fluid flow, the magnetic filter carriage comprising:

a frame arranged to support a plurality of magnetic rods, the frame comprising:

a first side plate, a second side plate and a guide plate extending between the first side plate and the second side plate, the guide plate including a plurality of locating pegs extending from an inner surface of the guide plate, wherein the frame is adapted to be mounted within a pressure vessel across a direction of the fluid flow between a fluid inlet and a fluid outlet of the pressure vessel; and two or more removable cassettes mounted in the frame, each removable cassette of the two or more removable cassettes comprising:

a retaining plate including locating apertures extending therethrough, each locating aperture being configured to fit over a respective one of the plurality of locating pegs of the frame, and at least two magnetic rods of the plurality of magnetic rods attached to the retaining plate so as to be aligned in a row of magnetic rods and such that each magnetic rod of the at least two magnetic rods is supported by the removable cassette at both a first end and a second end of the magnetic rod in a fixed orientation, wherein one of the locating apertures is aligned with the row of magnetic rods and disposed between two of the at least two magnetic rods.

2. A magnetic filter carriage as claimed in claim 1, further comprising guide members provided on an outer side of the frame for engaging with cooperating members of the pressure vessel so as to allow sliding movement between the magnetic filter carriage and the pressure vessel, wherein the frame comprises a side wall, and wherein one of the guide members extends a length of the side wall.

3. A magnetic filter carriage as claimed in claim 1, wherein the frame is arranged to support the plurality of magnetic rods such that each magnetic rod of the plurality of magnetic rods extends substantially parallel to the other magnetic rods of the plurality of magnetic rods.

4. A magnetic filter carriage as claimed in claim 1, in which each removable cassette of the two or more removable cassettes comprises: a pair of mounting blocks or plates attached to opposing ends of the at least two magnetic rods, and wherein the pair of mounting blocks or plates is attachable to opposite sides of the frame.

5. A magnetic filter carriage as claimed in claim 1, wherein the two or more removable cassettes are arranged in a plurality of rows of cassettes in the frame, and wherein adjacent rows of the plurality of rows of cassettes comprise a different number of magnetic rods of the plurality of magnetic rods.

6. A magnetic filter carriage as claimed in claim 1, each removable cassette of the two or more removable cassettes carrying three or four magnetic rods of the plurality of magnetic rods.

7. A magnetic filter carriage as claimed in claim 1, wherein each magnetic rod of the plurality of magnetic rods comprises a plurality of magnets.

8. A magnetic filter carriage as claimed in claim 1, wherein each magnetic rod of the at least two magnetic rods is removable from the removable cassette.

9. A system comprising a pressure vessel and a magnetic filter carriage, wherein the pressure vessel comprises opposed side walls comprising guide members for cooperating with guide members on the magnetic filter carriage, and wherein the magnetic filter carriage comprises:

a frame arranged to support a plurality of magnetic rods, the frame comprising:

a first side plate, a second side plate, and a guide plate extending between the first side plate and the second side plate, the guide plate including a plurality of locating pegs extending from an inner surface of the guide plate wherein the frame is adapted to be mounted within the pressure vessel across a direction of a fluid flow between a fluid inlet and a fluid outlet of the pressure vessel; and two or more removable cassettes mounted in the frame, each removable cassette of the two or more removable cassettes comprising:

a retaining plate including locating apertures extending therethrough, each locating aperture being configured to fit over a respective one of the plurality of locating pegs of the frame, and at least two magnetic rods of the plurality of magnetic rods attached to the retaining plate so as to be aligned in a row of magnetic rods and such that each magnetic rod of the at least two magnetic rods is supported by the removable cassette at both a first end and a second end of the magnetic rod in a fixed orientation, wherein one of the locating apertures is aligned with the row of magnetic rods and disposed between two of the at least two magnetic rods.

10. A system as claimed in claim 9, comprising an operable hatch or lid of sufficient dimension so as to allow insertion and removal of the magnetic filter carriage in to and out of the pressure vessel.

11. A system as claimed in claim 9, in which the magnetic filter carriage is arranged such that the cross-sectional area of the magnetic filter carriage receives at least about 90% of fluid flow through the pressure vessel.

12. A system as claimed in claim 9, in which the pressure vessel is configured to contain fluid at a pressure of between 10 and 50 bar.

13. A system as claimed in claim 9, in which the pressure vessel is configured to contain fluid at a temperature of between −10 and +50° C.

14. A system as claimed in claim 9, in which the magnetic filter carriage is configured to remove magnetically susceptible contaminants from a fluid flowing at a rate of between 750 and 2000 $m^3$ per hour.

15. A system as claimed in claim 9, in which each removable cassette of the two or more removable cassettes comprises: a pair of mounting blocks or plates attached to opposing ends of the at least two magnetic rods, wherein the pair of mounting blocks or plates is attachable to opposite sides of the frame.

16. A system as claimed in claim 9, wherein the two or more removable cassettes are arranged in a plurality of rows of cassettes in the frame, and wherein adjacent rows of the plurality of rows of cassettes comprise a different number of magnetic rods of the plurality of magnetic rods.

17. A system as claimed in claim 9, wherein each magnetic rod of the plurality of magnetic rods comprises a plurality of magnets.

18. A system as claimed in claim 9, in which the pressure vessel is configured to contain fluid at a pressure of between 30 to 100 bar.

19. A system as claimed in claim 9, in which the fluid is aviation fuel.

* * * * *